United States Patent [19]

Büttner

[11] 4,335,822

[45] Jun. 22, 1982

[54] TRANSPORT AND EMPTYING CONTAINER

[75] Inventor: Werner Büttner, Darmstadt, Fed. Rep. of Germany

[73] Assignee: Merck Patent Gesellschaft mit beschränkter Haftung, Darmstadt, Fed. Rep. of Germany

[21] Appl. No.: 211,592

[22] Filed: Dec. 1, 1980

[30] Foreign Application Priority Data

Dec. 21, 1979 [DE] Fed. Rep. of Germany ..... 2951667

[51] Int. Cl.[3] ..... B65D 47/02

[52] U.S. Cl. ..... 215/12 R; 215/309

[58] Field of Search ..... 215/309, 274, 12 R

[56] References Cited

U.S. PATENT DOCUMENTS 3,080,990 3/1963 Parkinson et al. ..... 215/274
3,544,281 12/1970 Phillips ..... 215/274 X
3,878,962 4/1975 Holbrook et al. ..... 215/309
4,234,095 11/1980 Safianoff ..... 215/309

*Primary Examiner*—Donald F. Norton
*Attorney, Agent, or Firm*—Millen & White

[57] ABSTRACT

A device for transporting and emptying very pure liquid chemicals capable of reacting with constituents of the atmosphere. The device includes container which has an upper part connected to a lower part by a flange having a gasket interposed between the container and the flange. The upper part of the container has filling and emptying tubes extending into the container, and the emptying tubes has rupture valves located therein for preventing contact between the very pure liquid chemicals in the container and constituents of the atmosphere which may be present in the top portion of the emptying tubes prior to emptying of the device.

11 Claims, 6 Drawing Figures

TRANSPORT AND EMPTYING CONTAINER

BACKGROUND OF THE INVENTION

This invention relates to a device suitable for the transportion and delivery of highly pure liquid chemicals capable of reacting with air.

There are many instances when chemicals having a very high purity are required. If these chemicals are capable of reacting with constituents of the air, for example, oxygen or atmospheric moisture, it becomes necessary to ensure that these chemicals cannot come into contact with air, either during transport and storage, or when they are emptied out.

For the manufacture of light transmitting fiber in particular, liquid chemicals, for example, silicon tetrachloride, phosphorus oxychloride, boron tribromide and germanium tetrachloride, are required in high purities. The presence of transition elements from the 4th period (vanadium to copper) in these liquid chemicals is particularly undesirable. Unfortunately, contamination with heavy metals, for example, iron, chromium and nickel, becomes virtually unavoidable when prior art stainless steel containers are used since, as a result of hydrolysis with atmospheric moisture which is virtually impossible to prevent during filling and emptying, hydrohalic acids are formed which attack the stainless steel container.

For this reason, these chemicals are often delivered in sealed glass ampoules. These glass ampoules have the disadvantage, however, that only a relatively small amount can be filled into each package and the emptying of the packages can only be carried out through very complicated procedures of sealing out air. A quartz container can also be used for this purpose, which includes fused-in connecting tubes. However, this type of container is extremely expensive and can therefore be manufactured for only relatively small quantities. Further, the cleaning of the container which is necessary before refilling, is very difficult since a sufficiently large opening into the container is generally not provided.

SUMMARY OF THE INVENTION

It is therefore one object of the invention to provide an inexpensive container for highly pure chemicals, which permits easy filling and emptying in an inert gas atmosphere, and which is easy to clean when re-used.

Upon further study, additional objects and advantages of the invention will become more readily apparent to those skilled in the art. To achieve these objects, the present invention includes a transport and emptying device, for highly pure liquid chemicals which are capable of reacting with constituents of air, said device comprising a container having a plurality of connecting tubes for filling and emptying. The container of the device is divided into two parts, a lower part for carrying the liquid chemicals therein, and an upper part which carries the connecting tubes. The two parts are joined by means of a flange which includes a gasket which is positioned between the two parts of the container.

BRIEF DESCRIPTION OF THE DRAWINGS

The invention will be explained in detail with reference to the accompanying drawings in which several preferred embodiments are shown.

DETAILED DESCRIPTION OF THE PREFERRED EMBODIMENTS

Figure 1:
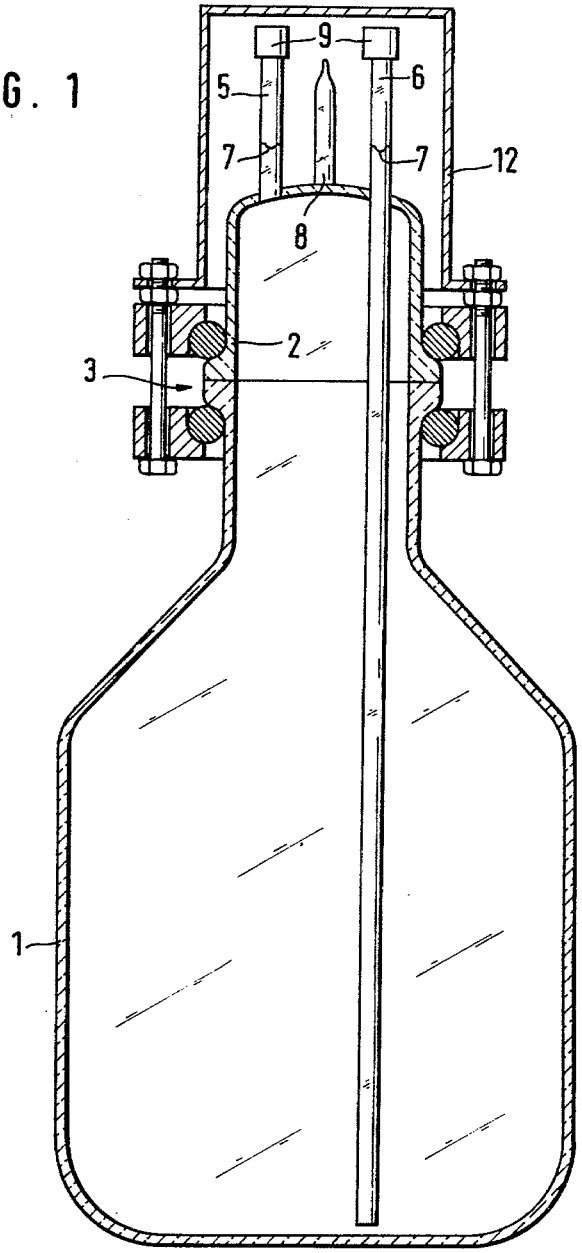
FIG. 1 is a side view, in partial cross-section, of the transport and emptying device of the present invention.
Figure 2:
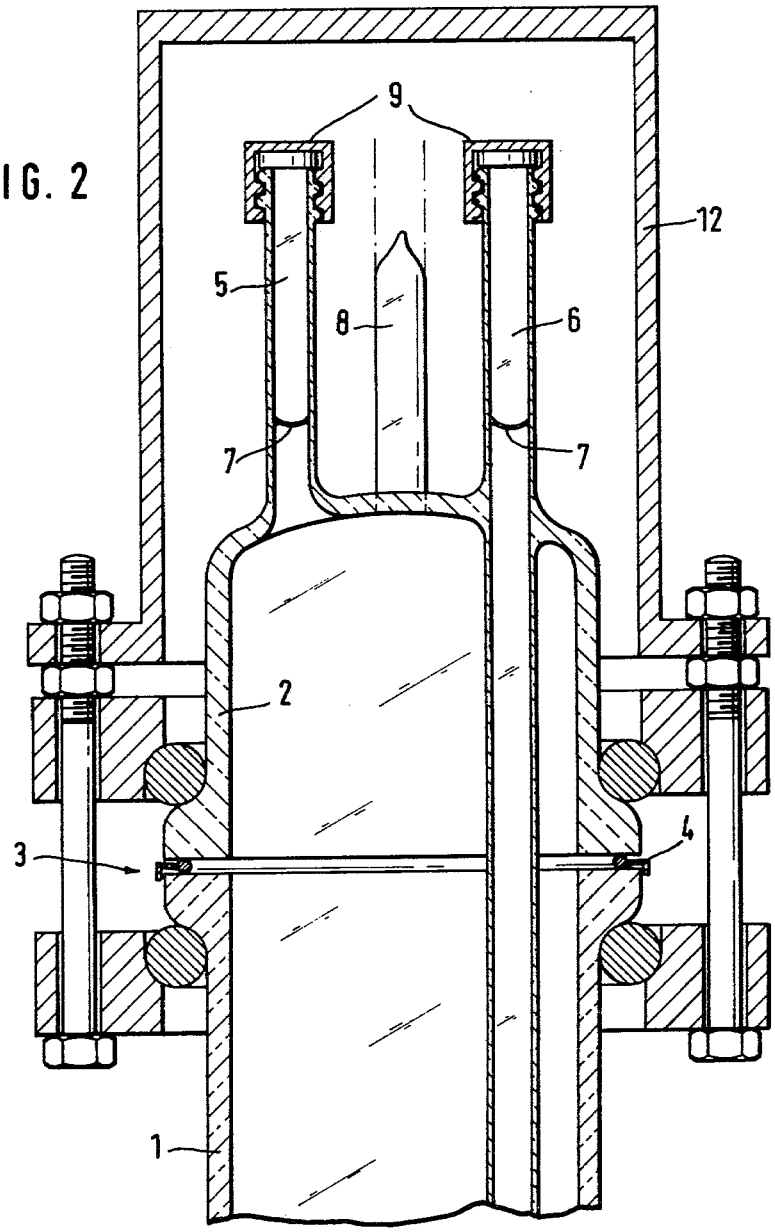
FIG. 2 is a cross-sectional view of the upper part of the device, showing the connection to the lower part.
Figure 3:
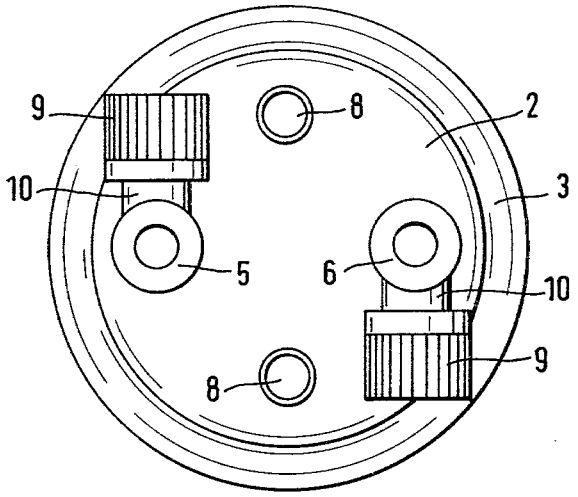
FIG. 3 is a top plan view of the upper part of the device.

Referring to FIGS. 1–3, the lower part of the container is marked 1 and the upper part of the container is marked 2. The two parts are joined at an outwardly extending flange portion 3 having a gasket 4 interposed therebetween.

Further, there is a bracket positioned on said flange portion, with resilient rings disposed between the flange portion 3 and the bracket, for tightening the two parts of the container together.

The emptying tubes 5 and 6 extend into the upper part 2 and have rupture valves 7 located therein.

Of the tubes 5 and 6, emptying tube 6 extends through the upper part 2 into the lower part 1 of the container, and the emptying tube 5 communicates with, and extends into the upper part 2. A filling tube 8, of which there can be a plurality and preferably two, is shown in the sealed state. The filling tubes too extend into and communicate with the upper part 2. The filling as well as the emptying tubes are fused with the upper part 2.

Figure 4:
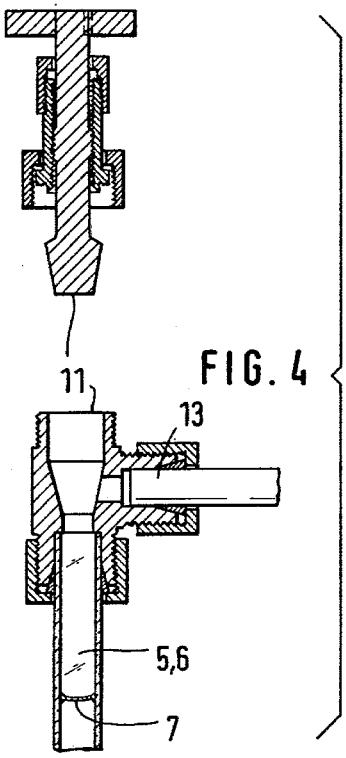
FIG. 4 is a cross-sectional view of an emptying tube, having an angle valve located thereon for emptying.
Figure 5:
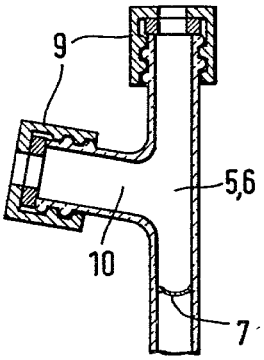
FIG. 5 is a cross-sectional view of another embodiment of the emptying tube of the present invention wherein said tube has screwed-on connections.

There are caps 9 placed on the emptying tubes. Further, FIG. 3 shows a side connection 10 as provided in a preferred embodiment of the emptying tubes of the invention. An angle valve 11, of another embodiment of the emptying tube, having a side connection to the angle valve, is shown in FIG. 4. Finally, FIG. 1 shows a protective hood 12 which can be fixed to the flange 3 for covering the emptying tubes 5 and 6 and the filling tube. 8.

Figure 6:
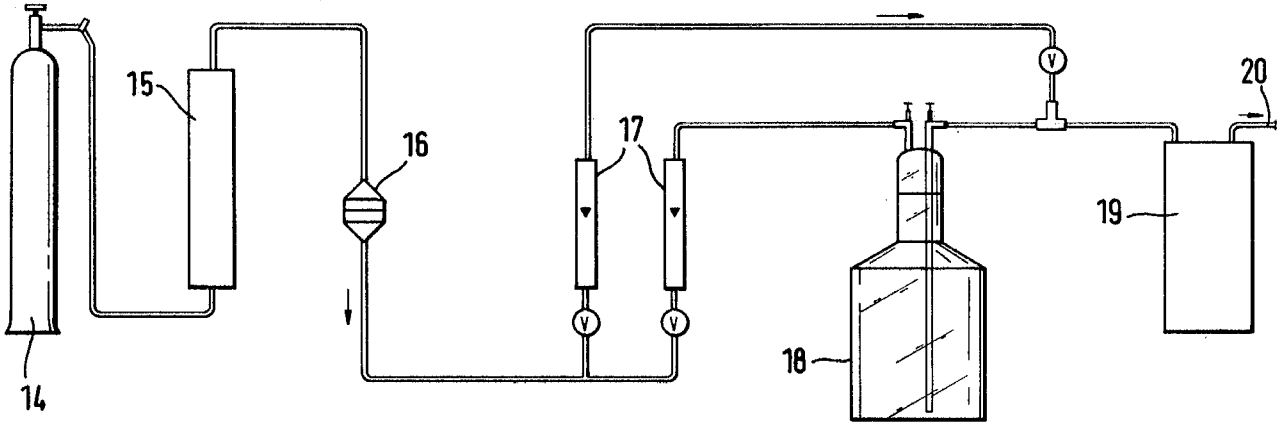
FIG. 6 is a schematic view showing the transport and emptying device of the present invention integrated into a fixed installation.

In FIG. 6, 14 designates the inert gas-supply, 15 a drying tower and 16 a fine filter. A flow meter is designated 17 and the transport and emptying device of the present invention is designated 18, a stock vessel is 19 and the flow outlet to the user 20.

The main advantage of the device of the present invention, preferably manufactured from glass, more particularly, from borosilicate glass of the Ist hydrolytic class, for example, Duran glass or Pyrex glass, is the fact that it is easy to handle when cleaning, filling and emptying. Since the container carrying the chemical is divided into two parts, specifically, an upper part 2 and a lower part 1, the device can be very thoroughly cleaned before filling without resulting in a great number of complications. Further, the use of a standard size flange 3 allows the use of the upper part 2 for a lower part 1 having any desired size, after the length of the emptying tube 6 has been appropriately adapted. Therefore, the holding capacity of the device according to the present invention can be adapted in a simple manner according to the needs of the user by merely holding various different sizes of the lower part 1 in stock.

After careful cleaning of the upper part 2 and lower part 1, they are assembled with the aid of the flange 3 and a gasket 4 which is made of an inert material, preferably Teflon, and the emptying tubes 5 and 6 which are sealed by rupture valves 7 are closed with caps 9 which can be either screwed on or pushed on. After a purge with an inert gas, the filling of the device with the chemical can then be carried out through the filling tubes 8 which are still open. Subsequently, the two filling tubes 8 are sealed by fusion. The chemical is thereby completely sealed against environmental influences and is ready for transporting. To protect the filling and emptying tubes 5, 6 and 8 from damage, the upper part 2 can be covered with a protective hood 12.

For emptying-out the chemical in an inert environment, the device can be fitted onto a fixed installation having a construction substantially as shown in the view of FIG. 6. When this operation is performed, the closing caps 9 are removed from the emptying tubes 5 and 6 and, if appropriate after securing an angle valve 11 in place, the emptying tubes 5 and 6 are connected to the inert gas supply and to the user through the side connection 10 or through the side connection 13 of the angle valve.

After the space above the rupture valves 7 is thoroughly flushed, the valves 7 are destroyed, for example, by introducing a clean glass rod thereinto, and the emptying tubes 5 and 6 are closed either by the upper part of the angle valve 11 after removal of the glass rod, or by a pierced cap 9, in which case the glass rod which has already been loosely positioned together with the cap 9 during flushing, remains in the connection 5 and 6. By injecting inert gas through the emptying tube 5, the contents of the device can then be passed through the emptying tube 6 and to the user's stock vessel.

Alternatively, the device of the present invention can itself be used as a stock vessel (so-called bubbler), in which case the supplying of the inert gas is merely effected through the emptying tube 6. After emptying, renewal of the rupture valves 7 and appropriate cleaning, the device can then be filled again and re-used.

Therefore, the present invention provides a transport and emptying device, which can be used not only in a very versatile manner with the greatest possible safety, but one which is also very easy to handle and inexpensive to manufacture.

The invention, having been described by way of example, it is not intended to be limiting in any way and other changes and modifications which are apparent to those skilled in the art are intended to be included therein.

What is claimed is:

1. A container for transporting and emptying very pure chemicals capable of reacting with constituents of the atmosphere, said container comprising:

a lower part closed main body having an opening at the top;

an upper part adapted for being connected to said lower part at said opening for being in communication therewith and said upper part being closed at the top;

first connecting tube means and second connecting tube means extending through the top of said upper part into said container; and flange means located for connecting said upper and lower parts at said flange means, said flange means having gasket means positioned between said flange means and said upper and lower parts respectively.

2. A container as in claim 1 wherein said first connecting tube means and second connecting tube means comprise two first connecting tubes for filling said container, and two second connecting tubes for emptying said container.

3. A container as in claim 1 wherein one of said two second connecting tubes for emptying said container extends through said upper part and down into the bottom of said lower part.

4. A container as in claim 1 wherein said two second connecting tubes have rupture valves located therein for sealing said two second connecting tubes closed.

5. A container as in claim 4 wherein said two second connecting tubes include a side mounted connection located above said rupture valves.

6. A container as in claim 1 wherein said gasket means is made of an inert material.

7. A container as in claim 6 wherein said inert material is Teflon.

8. A container as in claim 1 wherein said upper and lower parts are made of glass.

9. A container as in claim 8 wherein said glass is borosilicate glass.

10. A container as in claim 1 wherein said lower part closed main body has a size corresponding to the amount of liquid chemical desired to be filled thereinto and said upper part has a fixed standard size.

11. A container as in claim 1 further comprising a protective cap means positioned on said upper part for protecting said first connecting tube means and second connecting tube means against breakage.

* * * * *